US005273629A

United States Patent [19]

Meenan et al.

[11] Patent Number: 5,273,629

[45] Date of Patent: Dec. 28, 1993

[54] METHOD AND APPARATUS FOR SEPARATING CONTAMINANTS FROM FLUIDIZABLE SOLIDS AND CONVERTING THE CONTAMINATE TO LESS TOXIC OR NON-TOXIC MATERIALS

[75] Inventors: William C. Meenan, Waukegan; George D. Sullivan, Wilmette, both of Ill.

[73] Assignee: Recycling Sciences International, Inc., Chicago, Ill.

[21] Appl. No.: 829,910

[22] Filed: Feb. 3, 1992

[51] Int. Cl.[5] ..... C25B 1/00

[52] U.S. Cl. ..... 204/131; 204/194; 588/204; 588/209; 588/210; 588/211

[58] Field of Search ..... 204/131, 149, 194; 588/204, 209, 210, 211

[56] References Cited

U.S. PATENT DOCUMENTS 4,443,309 4/1984 Van Duin et al. ..... 204/149

4,585,533 4/1986 Habeeb ..... 204/149

4,685,220 8/1987 Meenan et al. ..... 588/209

*Primary Examiner*—John Niebling

*Assistant Examiner*—Arun S. Phasge

*Attorney, Agent, or Firm*—Marshall, O'Toole, Gerstein, Murray & Borun

[57] ABSTRACT

A process and apparatus for treating any fluidizable solid material having an organic oxidizable contaminant absorbed or adsorbed thereon, particularly a sludge contaminated with polychlorinated biphenyl or other toxic chemicals having a boiling point of at least 110° C. The method and apparatus includes heating the fluidizable solids, to a temperature of about 200°F. to about 700°F., preferably about 200°F. to about 400°F., e.g., by using hot turbulent gas at a temperature in the range of 850° to 2,500° F. to vaporize and thereby separate the toxic organic material. The recoverable or toxic contaminant vapors and/or liquids are charged to an electrochemical cell where they are oxidized to less toxic or non-toxic materials, such as HCl and $CO_2$.

14 Claims, 3 Drawing Sheets

METHOD AND APPARATUS FOR SEPARATING CONTAMINANTS FROM FLUIDIZABLE SOLIDS AND CONVERTING THE CONTAMINATE TO LESS TOXIC OR NON-TOXIC MATERIALS

FIELD OF THE INVENTION

This invention relates generally to methods and apparatus for treating a contaminated solid material, particularly a fluidizable solid, such as natural and artificial sludges, having one or more polychlorinated biphenyls, dioxins, or other hazardous or toxic, oxidizable hydrocarbons absorbed or adsorbed thereon, leaving a relatively uncontaminated solid material. More particularly, the present invention is directed to processes and apparatus for separation of polychlorinated biphenyls, dioxin and/or other hazardous or toxic oxidizable materials from a fluidizable solid material so that the fluidizable solids can be returned to the source or otherwise used as non-hazardous materials, in conjunction with an electrochemical cell for chemical reaction of the vaporized hazardous or toxic materials into non-toxic molecules. The separated polychlorinated biphenyls or other hazardous or toxic molecules, in gaseous form, liquid form, or in a state that the hazardous or toxic material is entrained with vaporized water vapor and can be carried as such between electrodes of an electrochemical cell, are fed to an electrochemical cell where the hazardous or toxic material is oxidized to less hazardous, less toxic, non-hazardous or non-toxic materials that can be used or reused industrially, or can be disposed of more easily.

BACKGROUND AND PRIOR ART

Polychlorinated biphenyls, or PCBs, were manufactured from 1929 to 1978. The manufacture of polychlorinated biphenyls has been banned in the United States since 1978. These chemicals have been widely used in capacitors, transformers, carbonless carbon paper, hydraulic pumps, vacuum pumps, heat transfer fluids, plasticizers, lubricants, caulking compounds, inks, paints and insect sprays. The major application of PCBs has been in large electrical capacitors and transformers. It has been estimated that over 800 million pounds of PCBs have been produced. A tremendous amount of these chemicals, suspected of causing cancer and birth defects, have been dumped over a number of years, either accidentally or deliberately, in an entirely reckless fashion. Commonly, these chemicals were dumped on land and in lakes, streams and waterways where they eventually collected in the bottom material in considerable concentrations.

The accumulation of PCBs in human and animal tissue and their toxic effects have been well documented. Further, PCBs are a significant hazard to the environment and their disposal has caused great concern. Incineration and land burial have been the main methods of PCB disposal. However, while incineration has been demonstrated somewhat effective for liquid contaminated PCBs, incineration of solid wastes containing PCBs has not been as successful (Federal Register, Vol. 41, No. 64, Apr. 1, 1976). There has, however, been acceptable incineration of solid wastes containing PCBs. Accordingly, most solids containing PCBs, such as waterway sludge, had to be buried in a chemical waste landfill. The great volume of sludge for transportation and burial represents a tremendous cost for such PCB disposal.

Because of the method of dumping toxic chemicals such as PCBs, a tremendous mass of soil has been contaminated. In the past, bottom soils or the like contaminated with these toxic organic fluids have been treated by attempting to burn or by burying them. Because of the nature of the materials in which the PCB contamination is often found, burning is extremely difficult and expensive and burying is often only a stop gap measure. Many microorganisms have been reported that can degrade PCBs to some degree. The limited information presently available indicates that PCBs have a strong affinity for soil.

It has been recognized that thermal decomposition of polychlorinated organic compounds is possible despite the very high degree of thermal stability of these compounds. U.S. Pat. No. 4,140,066 discloses a method of decomposing PCBs by exposure to heat in a combustion chamber which operates with extremely intense turbulence and pulsation under temperatures as low as 850° C. and with residence times as short as 0.1 second. However, the patent provides no method or apparatus for dealing with the problem of the treatment of mountainous amounts of contaminated, wet material having a relatively low heating value. Thus, while the method set forth in the '066 patent may be highly useful in eliminating PCB containing compounds in relatively small volumes, the process is not particularly helpful in dealing with contaminations on the order of tons in the form of residues in solids such as sludge.

A variety of techniques for incinerating waste material are known. The following U.S. patents are exemplary: U.S. Pat. Nos. 4,245,570; 3,858,534; 3,829,558; 3,812,794; 3,716,339; and 3,511,194. In accordance with related prior patents U.S. Pat. Nos. 4,402,274; 4,463,691; 4,685,220; 4,699,721; 4,778,606 and 4,793,937, all six patents hereby incorporated by reference, PCBs and other hazardous or toxic organic compounds are very effectively and efficiently separated from fluidizable solid materials, but the concentrated toxic material must then be handled for disposal, such as by burial or incineration. In accordance with the present invention, the vaporized toxic material is conveyed to an electrochemical cell for oxidation of the toxic material, after separation by vaporization, and optionally some intermediate processing steps, such as separation of entrained solid materials, to provide a complete, self-contained process for both removal of the toxic material, and treatment of the toxics to render them less toxic or hazardous or non-toxic or non-hazardous. Alternatively, or in addition to the treatment of the vapor in the electrochemical cell, liquid containing organic contaminants, such as PCBs can be conveyed through an electrochemical cell for oxidation of the toxic or hazardous organic contaminants contained in the liquid. The method and apparatus of the present invention are particularly effective for removal and chemical conversion of toxic or hazardous hydrocarbons from a fluidizable solid material, such as a sludge e.g., sand, clay, diatomaceous earth, charcoals, carbon, coals, silicas, alumina, silica-aluminas, metal particulates, metallic ores, and artificial sludges, such as those resulting from industrial spill absorption of liquids into an absorbent material. Once the toxic or hazardous material has been separated from the host material, or separated from other solids, the toxic or hazardous material can be stored as a liquid.

The electrochemical cell utilized in accordance with the present invention is fully disclosed in U.S. Pat. No. 3,616,339, hereby incorporated by reference. While U.S. Pat. No. 3,616,339 discloses that the cell is useful for oxidation of air impurities, such as cigar and cigarette smoke and other aromatic and unsaturated hydrocarbons to remove odors from air, the patent does not disclose or suggest the use of the cell for chemical reaction of toxic or hazardous substances such as PCBs and dioxin or that it is useful for removal of contaminants in liquid form.

SUMMARY OF THE INVENTION

In brief, the present invention is directed to a method and apparatus for separating polychlorinated biphenyls and other toxic or hazardous organic materials having a boiling point in the range of about 110° C. to about 750° C., from a solid material or liquid, particularly a fluidizable solid material. The most significant embodiment is directed to separation of toxic or hazardous oxidizable hydrocarbons such as PCBs, dioxin and the like from soil, or other contaminated solids, such as sludge. The fluidizable solids contaminated with one or more hydrocarbonaceous liquids, such as PCBs, are generally in the form of a wet sludge, usually containing more than about 10% liquid, although the process and apparatus described herein are also useful in removing polychlorinated biphenyls and other toxic or hazardous material from a relatively dry fluidizable solid material (i.e., 0–50% water) soil. The contaminated solid material is directed into a separator vessel where the contaminated solids are contacted with a hot gas or otherwise heated to a temperature sufficient to vaporize substantially all (99%+) of the toxic organic contaminant and to dry the solids and vaporize the toxic or hazardous contaminant, e.g., polychlorinated biphenyls. In one embodiment, the sludge is contacted with hot gas having a temperature in the range of about 850° F. to about 2500° F., to heat the contaminated material, to a temperature in the range of about 200° F. to about 400° F., without chemically incinerating or otherwise substantially reacting the molecule to a different molecule whereby practically all of the polychlorinated biphenyls or other toxic or hazardous material is contained in or on the fluidizable solids are vaporized and are easily removed from the separator vessel, together with the vaporized water, for subsequent conversion, by oxidation, to less toxic or non-toxic molecules, in an electrochemical cell.

It has been found that a sludge contaminated with an average of about 140 parts per million polychlorinated biphenyls can be dried and PCBs removed by contact with hot gas at about 850° to about 2500° F. in a single pass through the separator vessel, leaving less than 2 parts per million, and usually less than 1 part per million of PCB in the dried soil. The temperature in the separator vessel above a sludge-combustion gas contact zone is only about 300° F. to about 400° F. in a secondary fluidized bed region and the boiling point of the polychlorinated biphenyls is above 550° F.

The gas leaving the separator includes water vapor, combustion gases, polychlorinated biphenyls in vapor form, and a minor amount of entrained, relatively fine particulate solid material. The gas from the separator optionally can be further treated, if desired, in a number of alternative ways to concentrate the contaminants, in gaseous or liquid form, for efficient treatment in the electrochemical cell. The contaminants in gaseous or liquid form, however, can be oxidized from a gas that contains other molecules, such as water vapor and the like since the electrochemical cell will attract the oxidizable molecules, including the toxic or hazardous contaminant, and treat these materials from a relatively dilute gaseous or liquid stream of the toxic or hazardous material. In one embodiment, the entrained solids can be removed in a cyclone or filter and the remaining gas directed into the electrochemical cell. In another embodiment, the remaining gas can be condensed to form a PCB-water liquid composition. The condensed PCB-water composition can be conveyed to a relatively placid holding tank for removal of essentially uncontaminated water from an upper water level, since the PCBs are essentially insoluble in water (on the order of about 50 parts per billion) and substantially heavier than water. The PCBs then can be withdrawn from a bottom of the holding tank, conveyed through an electrochemical cell, or heated or otherwise vaporized and the vapor conveyed through the electrochemical cell for oxidation.

Accordingly, one aspect of the present invention is to provide a method and apparatus capable of separating polychlorinated biphenyls and other toxic organics from fluidizable solid materials and treating the separated toxic materials, in gas or liquid form, in an electrochemical cell to convert the toxics to less toxic or non-toxic materials.

In accordance with another aspect of the present invention, the method and apparatus of the present invention are capable of treating contaminated river, lake, and waterway bottom material to both separate polychlorinated biphenyls therefrom and electrochemically convert the toxic contaminants into molecules that are more easily and safely handled and disposed of, used or re-used industrially.

Still another aspect of the present invention is to provide a method and apparatus for vaporizing polychlorinated biphenyls from a fluidizable solid material, such as sludge, and thereafter electrochemically decomposing or reacting (oxidizing) the PCB vapors into carbon dioxide and hydrochloric acid and/or other relatively innocuous products that can be more easily disposed of, or used in industry, and the sludge safely returned to its original location or otherwise safely used, for example, as landfill material or as a component in concrete or asphalt.

A further aspect of the present invention is to provide a method and apparatus for separating polychlorinated biphenyls, dioxin, and other toxic or hazardous contaminants having a boiling point less than about 750° C. from a solid material by heating the solid material to a temperature in the range of about 200° F. to about 400° F., e.g., by contact with a hot gas at about 850–2500° F. in a fluidized hot gas-solid contact zone; passing the vaporized contaminants through a secondary fluidized bed zone within the separator at a temperature of about 200° F. to about 575° F.; removing the vaporized contaminants from the separator; and conveying the vaporized toxic material, in liquid or in gaseous form., through an electrochemical cell for oxidizing the toxic compound(s) into safer materials.

These and many other objects and advantages of the present invention are achieved by a method and apparatus for treating contaminated fluidizable solid materials, such as sludge, that includes the steps of heating the sludge to a temperature of about 200° F. to about 500° F. particularly about 200° F. to about 400° F., such as by contact with a hot gas at a temperature of about 850 to about 2,500° F., thereby driving the water and toxic contaminants from the sludge, in vapor form, and leaving a dry particulate mass of solids. The contaminant materials, before or after separation from water vapor and other vapors, are directed through an electrochemical cell in the vapor, and/or condensed liquid form where the toxic vapors and/or liquids are oxidized to less toxic or non-toxic materials, such as $CO_2$ gas and HCl gas or liquid.

In accordance with one embodiment of the present invention apparatus for treating polychlorinated biphenyl contaminated fluidizable solid materials includes a mixing means for mixing the solids to be treated and a drying means for separating the polychlorinated biphenyls and water from the solids and includes means for exposing the fluidizable solids to a hot gas stream to fluidize a portion of the solids for efficient vaporization and separation of the polychlorinated biphenyls. The apparatus further includes an electrochemical cell for oxidizing the PCB vapors and/or liquids into HCl gas or liquid, $CO_2$ gas and other possible compounds that are more easily disposed of.

DETAILED DESCRIPTION OF THE PREFERRED EMBODIMENT

Figures 2, 3, 4:
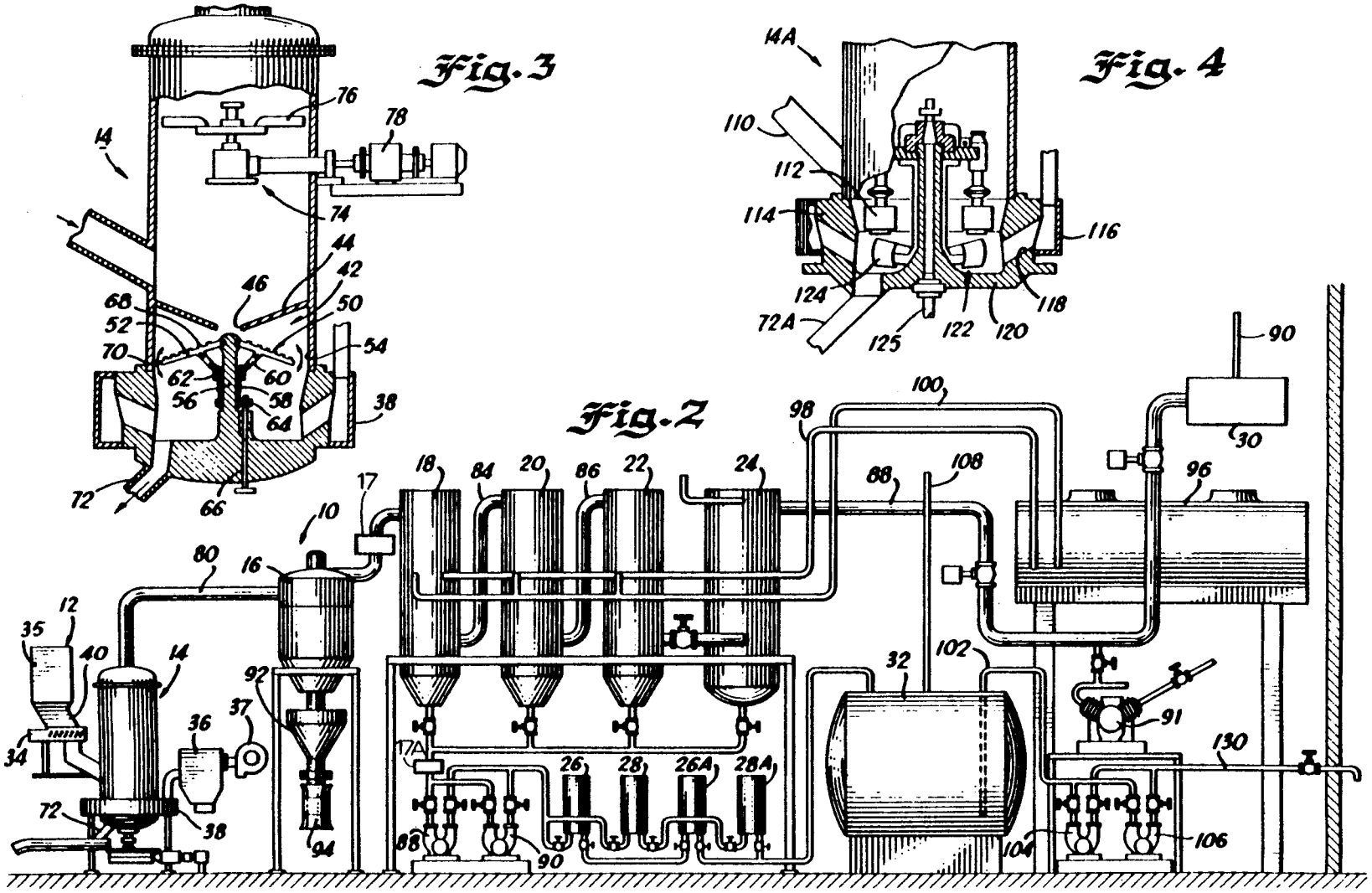
FIG. 2 is a schematic, elevational view of the apparatus in accordance with one embodiment of the present invention.
FIG. 3 is an enlarged view of the polychlorinated biphenyls separator or vaporizer portion of the apparatus of FIG. 1.
FIG. 4 is an enlarged view of another embodiment of the polychlorinated biphenyls separator or vaporizer portion of the apparatus of FIG. 1.

Referring to the drawings wherein like reference characters are used for like parts throughout the several views, a polychlorinated biphenyl contaminated solid treating apparatus 10, shown in FIG. 2, includes a mixer 12; a separator 14; a cyclone separator 16; an electrochemical oxidizer 17; a plurality of vapor condensing stages 18, 20 and 22; a non-condensed gas holding or storage vessel 24; two liquid filter sections 26 and 28; an activated carbon gas filter 30; and an aqueous storage vessel 32. Wet or dry solids, particularly fluidizable solids, contaminated with PCBs are poured into the apparatus 10 through the mixer 12. The nature of the solids is not critical, and the device is adapted to operate with soil, sand, mud, sewage, organic matter, clay, diatomaceous earth, charcoals, carbons, coals, silicas, aluminas, silica aluminas, metal particulates, metallic ores, and artificial sludges such as those formed by absorption of chemicals onto an absorbant, effluvia and the like, conveniently in the form of waterway bottom dredgings. The solids need not be fluidized to realize most of the advantages of the present invention so that other means for vaporizing the toxic organic contaminants can be used, e.g., 1R heat, microwave energy and the like. To achieve the most effective toxic separation, however, the contaminated solids are fluidized during heating for substantially complete vaporization, leaving less than 2 ppm toxic material and, preferably, less than 1 ppm toxic in the dry solid material.

The mixer 12 is conveniently a conventional mixer/-feeder with a screw or auger feeding mechanism 34 (i.e., FIG. 2) arranged generally horizontally within the mixer 12. As the fluidizable solid material, e.g., sludge is poured into the mixer 12, it is thoroughly mixed and forwarded into the toxic chemical separator 14. The sludge, for example as extracted from a body of water, is deposited into the mixer 12 having a hopper 35 of suitable size to hold a relatively large quantity of sludge above the feeding mechanism. If desired, for safety purposes, the hopper 35 can be a welded and pressure tested steel container with a gasketed top. When filled, the hopper 35 can be closed and sealed. The discharge from the mixer 12 can be controlled by a standard flow control device (not shown) to vary fluidizable solids flow into the separator 14 to correspond to separator operating capacity. The connection between the hopper 35 and the auger 34 section is flanged with a suitable gasket to eliminate the possibility of spillage.

The auger portion 34 of the mixer 12 transfers the fluidizable solids, generally in sludge form (for example, 5 to 90 percent water, and generally 30 to 70 percent water) from the hopper 35 to the separator 14. The auger section 34 has an electrically driven rotating variable speed screw or auger to supply the separator 14 with a continuous feed at approximately 1,000 pounds per hour of sludge. As shown in FIG. 2, the sludge may be poured in a wet state (including for example 20%–90% solids) into the separator 14 and quickly dried. Very hot air and combustion gases generated in burner or furnace 36 are blown inwardly via fan 37 from the bottom of the separator 14 through a wind box 38 and flow upwardly through the separator 14, drying the sludge with the hot turbulent gases. The combustion gases contacting the sludge in the separator 14 are at a temperature of from 850° F. to 2,500° F. To achieve the full advantages of the present invention, the sludge-contacting hot air and combustion gases are at a temperature of about 1400° F. to about 2,000° F. As shown in FIG. 2, the separator unit 14 will dry, classify and convey sludge in one continuous operation. The sludge or other fluidizable solids containing material enters the separator 14 through a sludge distributor section 40, connecting the hopper 35 to the auger section 34 of the mixer 12, to convey the sludge material into the separator 14 at a rate automatically controlled by differential pressure sensed within the separator 14.

The larger particulate material falls downwardly through the separator 14 at a rate controlled by a residence time controlling device designated generally by reference numeral 42 (FIG. 3). The residence time controlling device 42 includes a first frustoconical surface 44 angled downwardly to direct the sludge material to a central position 46 along a longitudinal axis of the separator 14. The sludge material, at least partially dried, falls through a central aperture 48 onto a rotating umbrella device 50 having a plurality of downwardly inclined, radially extending arms 52 extending close to (i.e., 2–6 inches from) an interior wall 54 of the separator 14. The umbrella 50 is generally frustoconical in shape but is directed downwardly from a central shaft 56 toward the bottom of the separator 14 to receive the sludge and to redirect it outwardly toward the interior wall 54 of the separator 14. The arms 52 of the frustoconical umbrella 50 are hingedly secured at their upper ends to a rotatable, annular tube 58 surrounding the central shaft 56. Each umbrella arm 52 is threadedly connected to the rotatable annular tube 58 through a linkage 60 and a threaded collar 62. A gear linkage 64 is disposed against the rotatable annular tube 58 and the gear linkage 64 is connected to an elongated handle 66 so that rotation of the handle 66 rotates the annular tube 58 thereby raising or lowering the collar 62 to change the angle of the umbrella arms 52, as indicated by the arrows in FIG. 3. An upper surface of each umbrella arm 52 includes a plurality of ridges 68 to decrease the rate of movement of the sludge, at least partially dried, along the upper surface of the umbrella arms 52.

Eventually, the dried sludge in particulate form tumbles off of the peripheral edges 70 of the umbrella arms 52 and collects at the bottom of the separator 14, flowing outwardly through a decontaminated, dried sludge outlet 72. From the outlet 72, any particulate matter that contains an excessive concentration of polychlorinated biphenyls, may be returned to the mixer 12 (FIG. 2) for recycling. The mixer 12 mixes the dried coarse particulate matter with the incoming wet sludge and feeds the mixture to the separator 14. The adequately treated sludge can be returned to its source or used in any manner that an uncontaminated soil might be used.

In a lower portion of the separator 14, the partially dry particulate matter is fluidized to form a fluidized bed for efficient vaporization of polychlorinated biphenyls. The finer particulates are propelled upwardly through the spinning product separator generally designated by reference numeral 74 (FIG. 3). The particle separator 74 includes spinning blades 76 rotated in an upper portion of the separator 14 by a motor 72. The fine particulate matter, entrained in the gas flow out of the separator 14, is propelled upwardly out of the separator 14 through conduit 80 (FIG. 2) into cyclone separator 16, and the larger particles (i.e., plus 200 mesh) are returned to the lower or hot gas-contacting fluidized bed portion of the separator 14.

The cyclone separator 16 separates the fine particulates from the gas and the gas exits from the cyclone separator 16 through conduit 82 to the electrochemical oxidizer 17 (FIG. 2). In the electrochemical oxidizer 17, gas-stream contaminants are converted to non-hazardous compounds while the gas passes along the anode of an electrochemical cell. For chlorinated hydrocarbons, the oxidation reaction occurring at the anode is $$C_xH_yCl_z + 2x\ H_2O \rightarrow x\ CO_2 + z\ HCl + (4x+y-z)H^{30} + (4x+y-z)e$$

The H+ ions are transferred from the anode to the cathode of the cell where they are converted to water by the reaction $$\left(\frac{4x+y-z}{4}\right)O_2 + (4x+y-z)H^+ + \left(\frac{4x+y-z}{2}\right)H_2O$$

Figure 1:
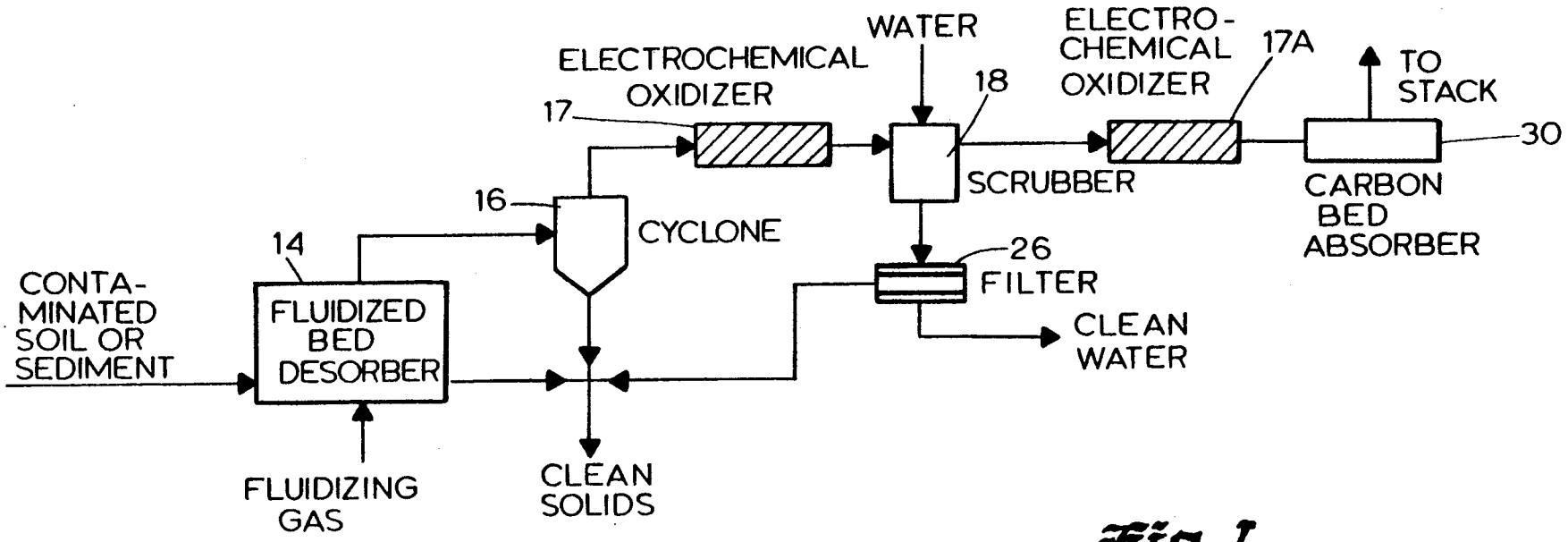
FIG. 1 is a schematic flow diagram showing the general separation and electrochemical oxidizer apparatus, in alternative locations, of the present invention.
Figure 5:
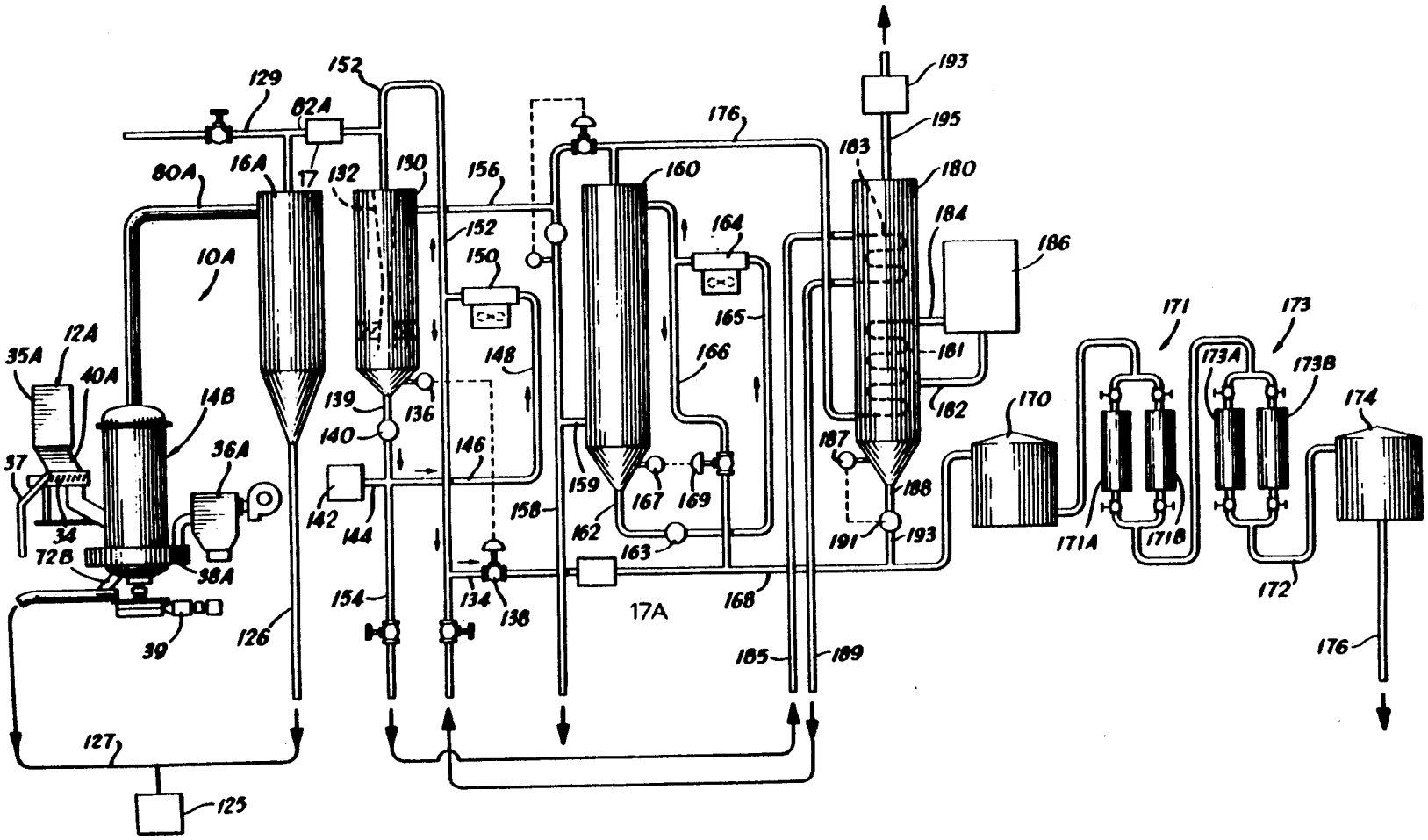
FIG. 5 is a schematic, elevational view of the apparatus in accordance with another embodiment of the present invention.

Thus the net effect is to destroy the toxic chlorinated hydrocarbons in the contact gas by converting them to hydrogen chloride (HCl) gas and carbon dioxide. The HCl is subsequently removed in the scrubber where it dissolves in the scrubber water, as shown in FIGS. 1 and 5 (which preferably is slightly alkaline to neutralize the acidity that is produced by the HCl) or in condensing stages 18 to 22 (FIG. 2) which are maintained in a slightly alkaline condition.

In addition to the advantages of potentially low capital investment and low energy consumption, electrochemical oxidation can be carried out at relative low temperatures (200–400° F.), which is compatible with the separation steps of the method and apparatus of the present invention.

The anode of the electrochemical cell 17 contains a surface of lead oxide or other metal or metal oxide in direct contact with the contaminated gas. In a preferred example, the size of the electrochemical cell is 12 inches ×12 inches. For the electrochemical cell 17, the electrolyte to be used will be, for example, sulfuric acid or phosphoric acid in an inert silicone-based matrix; the cathode will be Pt-supported carbon or other suitable material, and, preferably, two types of electrode materials for the anode will be used. The first anode material is, for example, the lead-dioxide electrode indicated in U.S. Pat. No. 3,616,339, and the second anode material is selected from materials commonly used in fuel cells, as well known in the art. More specifically, the electrochemical cell 17 comprises a sandwich of: (a) a positive, porous metal or metal oxide electrode, (b) a matrix pad abutting the positive electrode and comprising an electrolyte impregnated substrate, (c) a negative air electrode abutting the matrix pad and comprising a porous sheet comprising porous carbon or graphite or a metal or metal oxide, capable of electrolytically reducing oxygen, and (d) means for electrically connecting the cell to a direct current power source.

The vapor outlet from the electrochemical oxidizer 17 is conveyed to the first vapor condensing stage 18. Remaining vapor proceeds to succeeding vapor condensing stages 20 and 22 through conduits 84 and 86, respectively, and into the non-condensed vapor storage vessel 24, while the condensed liquids (essentially polychlorinated biphenyls and water) are optionally conveyed through another electrochemical oxidizer 17A, identical to the electrochemical oxidizer 17 described above for treatment of the contaminated vapor. The condensed liquids are conveyed by pumps 88 and 90, optionally through electrochemical oxidizer 17A, or directly through the two liquid filter sections 26 and 28 to aqueous waste storage vessel 32. The non-condensed vapors from storage vessel 24 are conveyed via conduit 88 to the activated carbon filter 30 and the filtered gas can be vented to the atmosphere through conduit 90. Conduit 90 can be connected through a valved conduit (not shown) to the condensing stages 18, 20, or 22 for recycle if found to contain a prohibitive quantity of separated contaminant. For many applications, the filter sections 26, 28, and 30 may not be necessary since the electrochemical oxidizer will have oxidized the contaminants to non-detectable levels. The solid material (soil particulates) exiting the cyclone unit 16 will fall into a welded steel collector 92 for analysis and are collected in a steel drum 94 with a locking top, for shipment by an E.P.A. approved hauler to an E.P.A. approved disposal site. Alternatively, if found to contain legal amounts of contaminants, the cyclone solids may be returned to their source.

All vapor leaving the separator unit 14 will exit through conduit 80, travel through the cyclone 16, electrochemical oxidizer cell 17, condensed liquid is optionally treated in the electrochemical oxidizer 17A, and the gas is discharged via conduit 82 into the vapor condensing stages 18, 20 and 22. These units are welded steel cyclones with evaporator coils mounted in each cyclone. The cooling system is supplied by a 72,000

BTU (6 ton) 2 stage air cooled condenser 96 cooled via conduits 98 and 100. The refrigeration lines are copper tubing. The vapor entering this section will pass over the coils and be condensed back to a liquid state. The liquid or aqueous waste will exit the cyclone condenser stages 18, 20 and 22 into the filter stages 26 and 28 for additional processing, e.g., recycle or treatment in an electrochemical oxidizer.

The present device is highly effective in separating in separator 14 such that one percent or less of the polychlorinated biphenyls, and generally less than about 0.3 to 1.0 ppm of the PCBs, remain in the dried sludge exiting the separator through conduit 72. The solids entrained into the gas from the separator 14 are removed from the cyclone separator 16 and will contain less than about 3 or 4 ppm polychlorinated biphenyls.

The residence time of the fluidizable solids within the separator 14 may be controlled by adjusting the angle of the umbrella 52 (FIG. 3) to control the rate of exhaust of the large particulate matter from the separator 14. The residence time of the fluidizable solids within the separator 14 generally on the order of about 1 minute to about 1.5 hours and generally about 5 to 10 minutes.

As shown in FIG. 4, the separator is a Williams Crusher and Pulverizer Company Roller Mill Model No. GNOME designated by reference numeral 14A and described in U.S. Pat. No. 4,245,570.

The separator 14A can replace separator 14 in FIG. 2. The entering fluidizable solid material from mixer 12 falls through a downwardly angled inlet chute 110 and into a crushing area defined between a plurality of rotating crushing elements or grinding rollers 112 and an annular, angled grinding roller ring 114. The grinding roller ring or bull ring 114 surrounds the grinding rollers 112 to define an upper level of a hot gas-sludge contacting area of the separator 14A. The entering sludge is initially fed to the crushing area between the grinding rollers and the surrounding grinding ring 114 where the rollers 112 crush the sludge against the ring 114 to a smaller size to provide more efficient vaporization of the polychlorinated biphenyls, contained in and on the fluidizable solids containing sludge.

The ground sludge is dried in the grinding area by contact with hot gas at about 850 to 2500° F. entering the separator 14A through a hot gas receiving bustle 116, including a series of downwardly and inwardly angled peripheral hot gas ports 118 surrounding a lower portion of the separator 14A for fluid communication of the bustle 116 and the lower portion of the separator 14A. The hot gas includes heated air and combustion gases from burner or furnace 36, as described with reference to FIG. 2, and is introduced into the separator 14A at a controlled velocity, i.e., 1500–2000 CFM at, for example, 1400° F. An example of a suitable burner or furnace 36 is a natural gas and air mix fan (37) assisted burner having a capacity of 1,500,000 BTU/hr. The fluidizable solids containing sludge is at least partially dried and a majority of the polychlorinated biphenyls are vaporized from the fluidizable solids in and below the grinding area. The larger (i.e., plus 200 mesh), partly dried fluidizable solids particles fall downwardly to a particle fluidized bed area defined between an uppermost level of the grinding area and the bottom closure wall 120 of the separator 14A (FIG. 4). In the coarse particle fluidized bed area, the falling coarser fluidizable solid particles are at least partly fluidized and agitated by the combined action of the incoming hot gases entering tangentially from the peripheral ports 118 and a rotating plow 122, including a plurality of radial plow blades 124. The plow blades 124 and grinding rollers 112 rotate continuously via drive shaft 125 to provide efficient hot-gas fluidizable solid particle contact so that the dried, decontaminated fluidizable solid exiting the bottom of the separator through outlet 72A contains less than about 5 PPM and generally less than about 1 PPM. The rate of rotation of the plow blades 124 controls the residence time of the fluidizable solids within the separator 14A and the rate of removal of the decontaminated sludge from the discharge outlet 72A.

The hot gases from the furnace flow upwardly within the separator 14A against the fall of coarser sludge particles, through and around the grinding area and carry finer sludge particles above the grinding area into a finer particle dilute phase fluidized bed area defined between the uppermost level of the grinding area and the particle separator 74, shown in FIG. 3. The product separator 74 is not shown in FIG. 4 since it is the same as shown in FIG. 2. The hot gases and finer, fluidized solid particles in the finer particle secondary or dilute phase fluidized bed area are cooled as a result of the entering fluidizable solids to a temperature of about 200–550° F., for example 320° F. The upwardly directed finer fluidized particles contact the spinner separator 74, described with reference to FIG. 3, to force most of the contacted particles downwardly for further hot gas contact and vaporization of contaminants so that most of the particles are decontaminated and recovered from the discharge outlet 72A at the bottom of the separator 14A.

The particle separator 74 provides a micrometer adjustment of size of the fineness passing through the spinner blades 76 to the cyclone separator 16 through conduit 80 (FIG. 2). The size of particles conveyed to the cyclone separator 16 is precisely controlled by adjusting the rotating speed and the number of blades 76 of the spinner 74 (FIG. 3). This turning action of the spinner blades 76 controls the air vortex at the particle separator 74 and controls the size of rejected oversize particles away from the hot gas stream and back down into the classifying, crushing area of separator 14A (FIG. 4).

The cyclone separator 16 (FIG. 2) removes substantially all of the finer particles (99.99%) conveyed thereto by the frustoconical collector 92 and collection drum 94 so that the combustion gases, air, water vapor and any small amount of vaporized polychlorinated biphenyls that escape the electrochemical oxidizer cell 17 are conveyed to the aqueous filter condenser stages 18, 20, and 22.

The condenser stages 18, 20 and 22 condense and collect substantially all of the water vapor, any very small quantity of PCB and entrained solids from the entering gas stream. The condensable vapor is cooled, for example, from 320° F. to 85° F., and thereby condensed and removed from the bottom of the condenser stages 18, 20 and 22. All solids and a safe concentration of polychlorinated biphenyl contaminants will be wet via the condensing action to fall through the condensed water to the bottom of the condenser.

From the condenser stages 18, 20, and 22, the liquid optionally flows through electrochemical oxidizer 17A and then to an activated carbon filter 26 or 28 comprising an activated carbon filter material contained in a stell housing rated at 100 psig at 200° F. The aqueous waste will pass from the stage one section 26 to the duplex filters in the second stage 28. These units will be operated one at a time so as to be able to change filters without interrupting operation. The aqueous waste collected in storage vessel 32 will then be pumped via conduit 102 and pump 104 or 106 as clean water and pumped back to the source. For many applications the filter sections 26, 28, and 30 may not be necessary since the electrochemical oxidizer 17 and/or 17A will have oxidized the contaminants to non-detectable levels.

EXAMPLE

PCB laden sludge was removed from the North Branch of the Chicago River at the Chicago Tribune site in Chicago, Ill. Sampling of the removed bottom sediment showed that the sediment contained a minimum of 0.013 ppm PCBs (dry solid basis), a maximum of 164 ppm PCBs (dry solid basis), with an average of 38 ppm PCBs (dry solid basis). The bottom sediment contained a minimum of 13% water by weight, a maximum of 75% water and an average of 53% water by weight.

Based on the above mentioned analysis the composition of the sludge will vary, and worse case-best case situation based on total PCB leads to the following sludge composition:

| | Low PCB | Average PCB | High PCB |
|---|---|---|---|
| solids, wt. % | 25.0 | 47.0 | 87.0 |
| water, wt. % | 75.0 | 53.0 | 13.0 |
| Total % | 100.0 | 100.00 | 100.00 |
| PCB (dry basis) ppm | 0.013 | 38 | 164 |
| PCB (wet basis) ppm | $3.25 \times 10^{-3}$ | 18 | 143 |

This worse case-best case situation is more stringent than was actually found in the bottom sediment, since the analysis showed the lowest level of PCB with those samples containing the least amount of water. Of the twenty samples analyzed, fourteen were found to contain close to average amounts of water (53%) and PCB (38 ppm). Therefore the PCB removal process and apparatus will treat sludge of average composition at any given instant.

The PCB removal process and apparatus of the present invention will treat, for example, 1000 lb./hr. of bottom sediment (sludge) varying in amounts of water content from 75 wt.% to 13 wt.% (average: 53 wt.%) and PCB from 0.013 ppm to 164 ppm (average 38 ppm, dry basis) with 2144 lbms/hr. of 1400° F. combustion gas and yield two solid streams, one at 264 lbms/hr. containing 0.28 ppm (dry basis) PCB, another at 206 lbms/hr. containing 1.3 to 2.3 ppm (average 1.8 ppm, dry basis), a liquid stream at 663 lbms/hr. containing $2.56 \times 10^{-3}$ ppm (wet basis) PCB and $3 \times 10^{-7}$ wt.% solids (both virtually nondetectable), and an effluent wet non-condensable gas stream at 2011 lbm/hr. containing nondetectable amounts of entrained solids and PCB.

Turning now to FIG. 5, there is illustrated another embodiment of apparatus for removing a hydrocarbonaceous contaminant or contaminant mixtures, such as toxic chemicals from fluidizable solids, such as sludge, generally designated by reference numeral 10A. Fluidizable solids contaminated with PCBs is directed into the apparatus 10A through the mixer, generally designated by reference numeral 12A. The mixer 12A is a conventional mixer/feeder having a screw or auger feeding mechanism 34 such as that described with reference to FIG. 2. The mixer 12A includes a hopper 35A of suitable size to hold a relatively large quantity of fluidizable solids, such as sludge, above the auger or feeding mechanism disposed in a lower portion of the hopper 35A. If desired, additional material such as clean water or chemicals can be added to the sludge in the mixer/feeder 12A to provide a sludge having a predetermined percentage, e.g., 50% by weight, of water or to dissinfect or otherwise treat the sludge in the mixer/feeder 12A. If the sludge fed to the hopper 35A contains excess liquid, the excess liquid, i.e., water, may be removed, such as by draining the liquid from a lower outlet conduit 37 in the hopper 35A, or by filtering the contaminated fluidizable material to a desired liquid content, e.g., 30–70% liquid, prior to feeding the material to the hopper 35A. In some cases, contaminated solids having an undesirably high liquid content can be directed to a holding tank (not shown) where the solids can settle to the bottom and excess liquid can be removed from the top of the tank. The settled solids can then be pumped, such as by a screw or auger feed mechanism directly into the hopper 12 or 12A. The removed, excess liquid can by-pass the separator and be directed to the dilute toxic chemical storage vessel 170, or may be directed to the process water storage vessel 174, if sufficiently clean.

The sludge from the mixer/feeder 12A is fed by the feeder mechanism or auger through sludge distributor section 40A of the mixer/feeder 12A into a lower portion of a polychlorinated biphenyl separator 14B. The polychlorinated biphenyl separator 14B may be the device 14 or 14A described with reference to FIGS. 2–4. The separator operates at a pressure slightly below atmospheric, e.g., 3–5 inches of water below ambient. A burner or furnace 36A is connected to a lower portion of the separator 14B to blow hot air and combustion gases (850 to 2500° F.) into the separator 14B through conduit 39 and wind box 38A, described with reference to FIG. 2. The hot air and combustion gases flow upwardly through the separator 14B, drying the sludge with the hot turbulent gases. The combustion gases contacting the sludge in the separator 14B are at a temperature of from about 850° F. to about 2500° F., but can be at any temperature and flow rate sufficient to heat the contaminated material to a temperature in the range of about 200° F. to about 750° F., preferably in the range of about 200° F. to about 400° F. To achieve the full advantages of the present invention, the sludge-contacting hot gases, e.g., hot air and combustion gases, are at a temperature of about 1000° F. to about 1,800° F. The burner or furnace 36A may be supplemented with chemical injection, steam injection, or hot recycle gas diverted from another stage in the process in addition to the hot air and combustion gases fed to the burner 36A, as described with reference to FIGS. 2–4.

The polychlorinated biphenyls are vaporized and separated from the sludge in the sludge separator 14B, as described with reference to FIGS. 2–4, and the detoxified solid, dried sludge exits the separator 14B through conduit 72B, having a polychlorinated biphenyl content generally less than about 5 parts per million and usually in the range of about 0–4 parts per million preferably less than about 2 parts per million. Any particulate matter from the decontaminated, dried sludge outlet 72A containing an excessive polychlorinated biphenyl concentration may be returned to the mixer 12A for recycling. The mixer 12A mixes the dried coarse particulate matter with the incoming wet sludge and feeds the material to the separator 14B. The adequately treated dried sludge exiting the separator 14B can be returned to its source or used in any manner that an uncontaminated solid material, such as soil, might be used.

As described with reference to FIGS. 2–4, the partially dry particulate sludge material is fluidized in a lower portion of the separator 14B to form a fluidized bed for efficient vaporization of toxic chemical contaminants. The finer particulates are propelled upwardly through the spinning product separator, described with reference to FIGS. 3 and 4, where a coarser portion of the particulate matter is propelled downwardly to a lower hot gas-contacting fluidized bed portion of the separator 14B. A finer portion of the particulates are propelled upwardly out of the separator 14B through conduit 80A into cyclone separator 16A (FIG. 5). The cyclone separator 16A separates the fine particulates from the gas and the gas exits from the cyclone separator 16A through conduit 82A to the electrochemical cell oxidizer 17A and then to an upper portion of a scrubber 130. A portion of the gas may be recirculated to the wind box 38A of the separator 14B through conduit 129 (see Table IV). Virtually all of the fine particulates entrained in the gas leaving the separator 14B are propelled downwardly in the cyclone separator 16A and exit from a fine particulate exit conduit 126 at the bottom of the cyclone separator 16A as a clean, dry stream. The clean particulates from the cyclone separator in conduit 126 can be combined along conduit 127 with the detoxified solids exiting the separator 14B and collected in a suitable container 125 for testing, or the solids, if clean, can be returned to the original location or used in some other manner in which decontaminated solids, i.e., soil, are useful.

The vapors from the cyclone separator 16A flow through conduit 82A to the electrochemical oxidizer 17, as described with reference to FIG. 2, and then to a venturi scrubber 130. The scrubber 130 initially cools the gas exiting the top of the cyclone separator 16A along conduit 82A and removes some of the contaminants therefrom. The hot gases from conduit 82A enter the scrubber 130 through a centrally disposed venturi section 132 concurrently with a flow of water through the venturi section 132 entering the scrubber 130 from conduit 152. A suitable level detector 136 disposed near the base of the scrubber 130 is operatively connected to valve 138 in conduit 134 to control the removal of condensate formed in the scrubber 130. The condensate from scrubber 130 passes through conduit 139 and pump 140, and a portion of the condensate is recirculated to the top of the scrubber 130 through conduit 146. A portion of the condensate flows through conduit 134, optionally through electrochemical oxidizer 17A, and to the dilute toxic chemical storage vessel 170 for further treatment.

If there remains any PCBs in the gas entering the scrubber 130, they are condensed within the scrubber 130 and mixed with scrubbing water exiting the scrubber at the bottom of the scrubber through conduit 139. The electrochemical cell oxidizer 17 and/or 17A, however, should oxidize all but 0 to about 2 parts per million of the PCBs or other toxic organic oxidable material passing therethrough. If desired, acidic or basic chemicals may be added to the dilute toxic chemicals exiting the separator 130 via pump 140 through conduit 139 from chemical storage 142 and conduit 144 to provide scrubbing water having a desired pH or to convert the HCl or other oxidized products into a useful industrial product. The dilute toxic chemicals and cooling water from the bottom of the scrubber 130 are recycled through conduits 146 and 148 and through a cooler 150 to provide scrubber cooling water having a sufficiently low temperature for condensation of incoming water vapor and chemical vapors. The cooled, recirculated water flows through conduit 152 back to the top of the scrubber.

Vapors from the scrubber 130 exit from upper portion of the scrubber 130 through conduit 156 and are conveyed through conduit 158. A portion of the vapors from conduit 158 may be recycled to the separator 14B, the remainder being conveyed through conduit 159 to a lower portion of another scrubbing column or final gas washer 160. In the final gas washer 160, the gas from the scrubber 130 is further cooled by direct contact with countercurrently flowing cooling water to condense any possible remaining polychlorinated biphenyls from the gas. The final gas washer 160 includes any suitable gas liquid contact medium therein (not shown) such as trays, packing material or dual-flo decks, and this device should achieve condensation and scrubbing of the remaining from the gas entering the final gas washer 160. The polychlorinated biphenyls condensed and mass transferred to the liquid are removed from the final gas washer 160 at the bottom through conduit 162 and any condensed polychlorinated biphenyls and water can be circulated back to washer 160 through cooler 164 by means of pump 163 for additional condensation of polychlorinated biphenyls from the gas.

A suitable level detector 167 disposed near the base of the washer 160 is operatively connected to valve 169 in conduit 166 to control the passage of condensate, formed in the washer 160, through conduit 168 to the dilute polychlorinated biphenyls storage vessel 170 for further treatment.

The gas exiting an upper surface of the final gas washer 160 along conduit 176 enters a lower portion of a chiller 180. The chiller 180 is not always needed, but is used where necessary to achieve removal of a final portion of the polychlorinated biphenyls contained in the gas stream by contact of polychlorinated biphenyl-bearing gas with coils 181 carrying coolant recirculated through conduits 182 and 184 and refrigeration unit 186. An activated carbon filter 193 is disposed in gas conduit 195 at the top of the chiller 180. The carbon filter 193 is not always needed since the electrochemical cell 17 and/or 17A will oxidize the contaminants to non-detectable levels, but is used when necessary to achieve removal of a final portion of polychlorinated biphenyls or other hazardous or toxic hydrocarbons in gas conduit 195.

A suitable level detector 187 disposed near the base of chiller 180 is operatively connected to valve or pump 191 in chiller exit conduit 188 to control the removal of condensate formed in the chiller 180. The condensate passes through conduits 193 and 168 to the dilute toxic chemical storage vessel 170 for further treatment. A portion of the chiller 180 includes a re-heat section having coils 183 which receive effluent water from venturi scrubber 130. The effluent water from the scrubber 130 passes through conduit 154, through conduit 185, and through 183, exiting the chiller 180 through conduit 189 and back to the top of the scrubber 130 through conduit 152. Reheating of the gas exiting the chiller 180 by the above-described recirculation of the water from scrubber 130 substantially increases the dry-bulb temperature of the gas exiting the chiller 180 to eliminate steam plume problems. Any dilute polychlorinated biphenyls removed from a lower portion of the chiller 180 along conduit 188 join the dilute polychlorinated biphenyls from final gas washer 160 in conduit 168 and are conveyed into the dilute polychlorinated biphenyl storage vessel 170 for further treatment.

The foregoing detailed description has been given for clearness of understanding only and no unnecessary limitations should be understood thereof rom as many modifications will be obvious to those skilled in the art.

What is claimed and sought to be secured by the Letters Patent of the United States is:

1. A method for treating a solid material contaminated with a toxic organic, oxidizable contaminant comprising:

heating said material to a temperature of about 200° F. to about 750° F. for a period of time sufficient to vaporize substantially all of the toxic contaminant, thereby separating the toxic contaminant, in vapor form, from the solid material;

conveying the toxic contaminant, in vapor form, through an electrochemical cell including a positive porous metal or metal oxide electrode in direct contact with the contaminant vapor, a porous negative electrode and an electrolyte impregnated substrate contacting the positive and negative electrodes, said negative electrode capable of electrolytically reducing oxygen and in direct contact with the vaporized toxic contaminant; and supplying electric current to the cell sufficient to cause oxidation of said vaporized contaminant.

2. The method of claim 1, wherein the material is heated with a hot gas at a temperature of about 850° F. to about 2500°for a period of about 1 minute to about 1.5 hours.

3. The method of claim 2, wherein the toxic contaminant is a polychlorinated biphenyl and wherein the hot gas entrains a portion of the material, as fine particulates, with said vaporized polychlorinated biphenyls.

4. The method of claim 3 further including separating the particulates from the polychlorinated biphenyls.

5. A method of removing an oxidizable, toxic or hazardous organic contaminant from a fluidizable solid material comprising:

conveying said fluidizable solids to a dryer heated sufficiently to vaporize substantially all of the organic contaminant from the solid material;

conveying the vaporized organic contaminant through an electrochemical cell including a positive metal or metal oxide electrode in direct contact with the contaminant vapor, a negative electrode and an electrolyte, in an inert matrix, contacting both electrodes; and supplying electric current to the cell sufficient to cause oxidation of said organic vaporized contaminant at the positive electrode.

6. A method of removing a toxic organic oxidizable contaminant from a fluidizable contaminated solid material comprising:

contacting said contaminated solid material with a hot turbulent gas at a temperature of at least about 850° F. in a hot gas-fluidizable solids first fluidized bed contacting zone of a vaporization chamber to fluidize at least a portion of said fluidizable solids in said lower portion of said vaporization chamber, to vaporize a majority of said organic contaminant from said fluidizable solids in said lower portion and to cool said hot gases;

conveying said cooled has upwardly through said vaporization chamber at a rate sufficient to propel a finer particulate portion of the fluidizable solids above the first fluidized bed contacting zone to a second fluidized bed contacting zone at a lower temperature than, and disposed above, said first fluidized bed contacting zone, fluidizing a finer particulate portion of the fluidizable solids by said cooled gases, and vaporizing additional organic contaminants from said fluidized finer particulates in said second fluidized bed contact zone;

recycling a portion of the fluidizable solids particulates from the second fluidized bed down to the first fluidized bed for further vaporization of organic contaminants from said recycled particulates; and conveying sand gases and vaporized organic contaminants out of the vaporization chamber to an electrochemical cell oxidizer including a positive metal or metal oxide electrode in direct contact with the vaporized organic contaminants, a negative electrode, and an electrolyte, in an inert matrix, contacting both electrodes, for oxidation of substantially all of the vaporized organic contaminants.

7. The method of claim 6, wherein the second fluidized bed has a temperature of about 250° F. to about 500° F.

8. The method of claim 7, wherein the second fluidized bed has a temperature of about 300° F. to 350° F.

9. The method of claim 6 including separating the fluidizable solids particulates from the vapor conveyed out of the vaporization chamber.

10. The method of claim 6 including grinding the fluidizable solids in the vaporization chamber while contacting said fluidizable solids with said hot gas.

11. The method of claim 10, wherein said first fluidized bed is disposed below an area in said vaporization chamber where said fluidizable solids are ground and including conveying a coarser portion of the ground fluidizable solids down to said first fluidized bed and agitating the coarser fluidizable solids in said first fluidized bed to achieve more efficient vaporization of said polychlorinated biphenyls.

12. The method of claim 6, wherein the contaminated solid material includes at least 10% by weight water.

13. An apparatus for treating an oxidizable toxic organic material-contaminated sludge comprising:

vaporizing means for vaporizing the organic contaminants and water from the sludge leaving 10 PPM or less of the organic contaminants in the sludge;

means for separating fine particulate solid material from the gas conveyed out of the separating means; and electrochemical cell oxidizing means in fluid communication with the vaporizing means for electrochemically oxidizing vaporized organic contaminants into less toxic materials, said cell means including a positive metal or metal oxide electrode in direct contact with the vaporized organic contaminants, a negative electrode, and an electrolyte, in an inert matrix, contacting both electrodes.

14. An apparatus for treating an oxidizable organic material-contaminated sludge comprising:

separating means for separating said contaminant and water from the sludge thereby leaving 5 PPM or less of said contaminant in the sludge, said separating means including means for exposing the sludge to a hot gas stream to dry the sludge and convey water vapor, gaseously entrained contaminant and sludge particulates away from said separating means;

means for separating the particulates from the water and organic contaminants; and electrochemical cell oxidizing means in fluid communication with the vaporizing means for electrochemically oxidizing the vaporized organic contaminants into less toxic materials, said cell means including a positive metal or metal oxide electrode in direct contact with the vaporized organic contaminants, a negative electrode, and an electrolyte, in an inert matrix, contacting both electrodes.

* * * * *

UNITED STATES PATENT AND TRADEMARK OFFICE

CERTIFICATE OF CORRECTION

PATENT NO. : 5,273,629

DATED : DECEMBER 28, 1993

INVENTORS : WILLIAM C. MEENAN and GEORGE D. SULLIVAN

It is certified that error appears in the above-identified patent and that said Letters Patent is hereby corrected as shown below:

Column 7, line 50, in the formula, "$H^{30}$" should be -- $H^+$ --;

Column 7, line 50, in the formula, "e" should be -- $e^-$ --; and

Column 16, line 3, after "cooled" delete "has" and substitute therefor -- gas --.

Signed and Sealed this

Twenty-sixth Day of July, 1994

*Attest:*

Bruce Lehman

BRUCE LEHMAN

*Attesting Officer*

*Commissioner of Patents and Trademarks*